US010737857B2

(12) United States Patent
Choi

(10) Patent No.: US 10,737,857 B2
(45) Date of Patent: Aug. 11, 2020

(54) CLOSED CONTAINER COVER

(71) Applicant: NEOFLAM INC., Wonju-si, Gangwon-do (KR)

(72) Inventor: Woon Hwan Choi, Siheung-si (KR)

(73) Assignee: NEOFLAM INC., Wonju-si, Gangwon-Do (KR)

( * ) Notice: Subject to any disclaimer, the term of this patent is extended or adjusted under 35 U.S.C. 154(b) by 0 days.

(21) Appl. No.: 15/580,085

(22) PCT Filed: Jun. 1, 2017

(86) PCT No.: PCT/KR2017/005718
§ 371 (c)(1),
(2) Date: Dec. 6, 2017

(87) PCT Pub. No.: WO2018/056549
PCT Pub. Date: Mar. 29, 2018

(65) Prior Publication Data

US 2020/0031544 A1 Jan. 30, 2020

(30) Foreign Application Priority Data

Sep. 23, 2016 (KR) ..... 10-2016-0122164

(51) Int. Cl.
*B65D 53/02* (2006.01)
*B65D 45/32* (2006.01)

(52) U.S. Cl.
CPC ..... *B65D 53/02* (2013.01); *B65D 45/32* (2013.01); *B65D 2543/00101* (2013.01);
(Continued)

(58) Field of Classification Search
CPC ..... B65D 53/02; B65D 53/00; B65D 45/327; B65D 45/322; B65D 45/32; B65D 39/084;
(Continued)

(56) References Cited

U.S. PATENT DOCUMENTS 1,369,969 A * 3/1921 Fairbanks et al. ..... B65D 45/28 220/323
2,156,540 A * 5/1939 Melrath ..... B65D 39/084 220/257.2
2,198,125 A * 4/1940 Nelson ..... A47J 27/092 220/256.1

(Continued)

FOREIGN PATENT DOCUMENTS

JP 2007-008479 1/2007
KR 20-0365936 10/2004

(Continued)

OTHER PUBLICATIONS

International Search Report for International Application No. PCT/KR2017/005718, dated Aug. 22, 2017.

(Continued)

*Primary Examiner* — Robert J Hicks

(74) *Attorney, Agent, or Firm* — Kile Park Reed & Houtteman PLLC

(57) ABSTRACT

A closed container cover includes an upper plate moves down in accordance with rotation of a rotary knob and pushes outward a packing portion provided on a circumference of a lower plate, thereby having advantages that an inside of a container main body is easily closed by a simple operation, and production processes are decreased with the minimum elements to increase efficiencies of the production and the processes and significantly reduce production costs and lowering a selling price.

3 Claims, 5 Drawing Sheets

(52) U.S. Cl.
CPC ..... *B65D 2543/00231* (2013.01); *B65D 2543/00564* (2013.01); *B65D 2543/00972* (2013.01)

(58) Field of Classification Search
CPC ..... B65D 51/18; B65D 51/24; B65D 41/06; B65D 41/0435; B65D 41/065; B60J 10/20; B60J 10/26
USPC ... 220/367.1, 242, 241, 254.8, 254.2, 254.1, 220/259.4, 259.3, 256.1, 212, 293, 288, 220/304, 378; 277/647, 644
See application file for complete search history.

(56) References Cited

U.S. PATENT DOCUMENTS 2,462,445 A * 2/1949 Weiss ..... B65D 39/12 215/262
2012/0285958 A1* 11/2012 Lee ..... B65D 45/327 220/235
2012/0305558 A1* 12/2012 Steininger ..... B65D 43/022 220/235

FOREIGN PATENT DOCUMENTS

| | | |
|---|---|---|
| KR | 10-2008-0112335 | 12/2008 |
| KR | 10-2012-0020814 | 3/2012 |
| KR | 10-2014-0011738 | 1/2014 |
| KR | 20-0472089 | 4/2014 |

OTHER PUBLICATIONS

Written Opinion for International Application No. PCT/KR2017/005718 with English translation, dated Aug. 22, 2017.

* cited by examiner

CLOSED CONTAINER COVER

CROSS-REFERENCE TO RELATED THE APPLICATION

The application claims priority from Korean Patent Application No. 10-2016-0122164 filed on Sep. 23, 2016 in the Korean Intellectual Property Office, the disclosure of which is incorporated herein by reference.

BACKGROUND

Field

The present disclosure relate to a closed container cover, and more particularly to a closed container cover 100, which is coupled to an upper portion of a quadrangular container main body 200 and closes an inside of the container main body 200, the closed container cover 100 including: an upper plate 110 configured to include a coupling hole 111 formed in a center portion thereof, and a stepped portion 112 formed on an inner surface of the coupling hole 111; a rotary knob 120 configured to be inserted in the coupling hole 111, and include a wing 121 formed on an upper outer surface thereof and seated on the stepped portion 112, and a screw thread 122 formed an a lower outer surface; a lower plate 130 configured to couple with the upper plate 110, and include a tap coupling groove 131 formed in a center portion thereof and screw-coupling with the rotary knob 120, and an insertion groove 132 formed on an outer surface thereof; and a packing portion 140 configured to be made of an elastic material and inserted in the insertion groove 132, and include a circumferential surface tapering outward, wherein the upper plate 110 moves down so that an outer surface of the upper plate 110 can press an inner surface of the packing portion 140 and an outer surface of the packing portion 140 can be in contract with an inner surface of the container main body 100 if the rotary knob 120 is rotated in a state that the lower plate 130 is seated on the inner receiving projection 210 of the container main body 200.

Description of the Related Art

To keep food fresh for a long time and store the food sanitarily, food is generally filled in a closed container and a suitable amount of food is taken from the closed container if necessary.

Such a closed container has a structure for preventing air from getting in or out of the closed container. To this end, elastic packing is typically provided in a coupling potion between a container main body and a cover.

The closed container with the foregoing structure has been published in various embodiments, and for example, disclosed in the following Patent document 1 (Korean Utility Model No. 20-0472089, titled "AIRTIGHT CONTAINER").

In the Patent document 1, the "airtight container" includes a cylindrical container 200 filled with content therein and having a smooth upper inner circumferential surface, and a lid 100 for closing and opening the entrance of the container 200, in which the lid 100 includes a lid body 110 perforated at the center thereof to have a center hole 113 with a contact nut 114 having a screw thread on the inner circumference of the center hole 113; a contact grip 120 formed with a contact bolt 123 moving up/down being screw-coupled to the contact nut 114, having a main surface inclined portion having a conical shape under the contact bolt 123, and formed with a grip wheel 121 in an upper portion; a plurality of contact operating members 130 placed under the lid main body 110, combined to form a circle, and rectilinearly moving in radial directions by pressure due to up/down movement of the main surface inclined portion 124; a guide plate 150 fixed to the bottom of the lid main body 110, and having a guide rib 151 radially formed on the top to guide the plurality of contact operating members 140 to rectilinearly move; and a circular outer packing 140 coupled to the outer circumference combined by the contact operating members 130 and close contacting the inner circumference of the container 200 when closed and generating inward elastic force to be separated from the inner circumference when the close is released; wherein the contact operating member 130 includes a push rod 131 having an inclined surface at the end thereof to correspond to the main surface inclined portion 124, and a packing contact portion 133 having an arc shape outside the push rod 131, thereby enhancing airtightness and minimizing spoilage of food, medicine and the like stored content.

However, the "airtight container" of the Patent document 1 includes so various elements that producing, manufacturing and processing efficiencies are deteriorated by massive production, and thus problems arise in that production costs increase and a selling price for a consumer becomes high.

RELATED ART LITERATURES

Patent Document (Patent document 0001) Patent document 1: Korean Utility model No. 20-0472089.

SUMMARY

An aspect of one or more exemplary embodiments is to provide a closed container cover, in which an upper plate moves down in accordance with rotation of a rotary knob and pushes outward a packing portion provided on a circumference of a lower plate, thereby having advantages that an inside of a container main body is easily closed by a simple operation, and production processes are decreased with the minimum elements to increase efficiencies of the production and the processes and significantly reduce production costs and sales costs.

In accordance with an exemplary embodiment, there is provided a closed container cover 100, which is coupled to an upper portion of a quadrangular container main body 200 and closes an inside of the container main body 200, the closed container cover 100 including: an upper plate 110 configured to include a coupling hole 111 formed in a center portion thereof, and a stepped portion 112 formed on an inner surface of the coupling hole 111; a rotary knob 120 configured to be inserted in the coupling hole 111, and include a wing 121 formed on an upper outer surface thereof and seated on the stepped portion 112, and a screw thread 122 formed an a lower outer surface; a lower plate 130 configured to couple with the upper plate 110, and include a tap coupling groove 131 formed in a center portion thereof and screw-coupling with the rotary knob 120, and an insertion groove 132 formed on an outer surface thereof; and a packing portion 140 configured to be made of an elastic material and inserted in the insertion groove 132, and include a circumferential surface tapering outward, wherein the upper plate 110 moves down so that an outer surface of the upper plate 110 can press an inner surface of the packing portion 140 and an outer surface of the packing portion 140 can be in contract with an inner surface of the container main body 100 if the rotary knob 120 is rotated in a state that the lower plate 130 is seated on the inner receiving projection 210 of the container main body 200.

Further, the packing portion 140 may include a contact surface 141 formed on an outer circumference thereof and having the same angle as the inner surface of the container main body 200 so as to be in close contact with the inner surface of the container main body 200 when the packing portion 140 is expanded outward as the upper plate 110 moves down.

Further, the upper plate 110 may include an inclined surface 113 formed on an outer circumference thereof at the same angle as the inner surface of the packing portion 140.

Further, the upper plate 110 may include a reinforcing rib 114 formed at a bottom corner thereof and arranged in a diagonal direction to transfer pressure to corners of the packing portion while the upper plate 110 is moved down by rotation of the rotary knob 120.

Further, the upper plate 110 may include an outer rib 115 formed on a bottom circumference thereof and preventing the upper plate 110 from rotating in the same direction as the rotary knob 120 while the upper plate 110 is moved down by the rotation of the rotary knob 120.

BRIEF DESCRIPTION OF THE DRAWINGS

The above and/or the aspects will become apparent and more readily appreciated from the following description of exemplary embodiments, taken in conjunction with the accompanying drawings, in which.

DETAILED DESCRIPTION OF EXEMPLARY EMBODIMENTS

Below, a closed container cover 100 according to an embodiment of the present disclosure will be described in detail with reference to the accompanying drawings. First, it will be appreciated that like numerals refer to like elements or components. Further, detailed descriptions about well-known functions and features, which may cloud the gist of the present disclosure, will be avoided.

Figure 1:
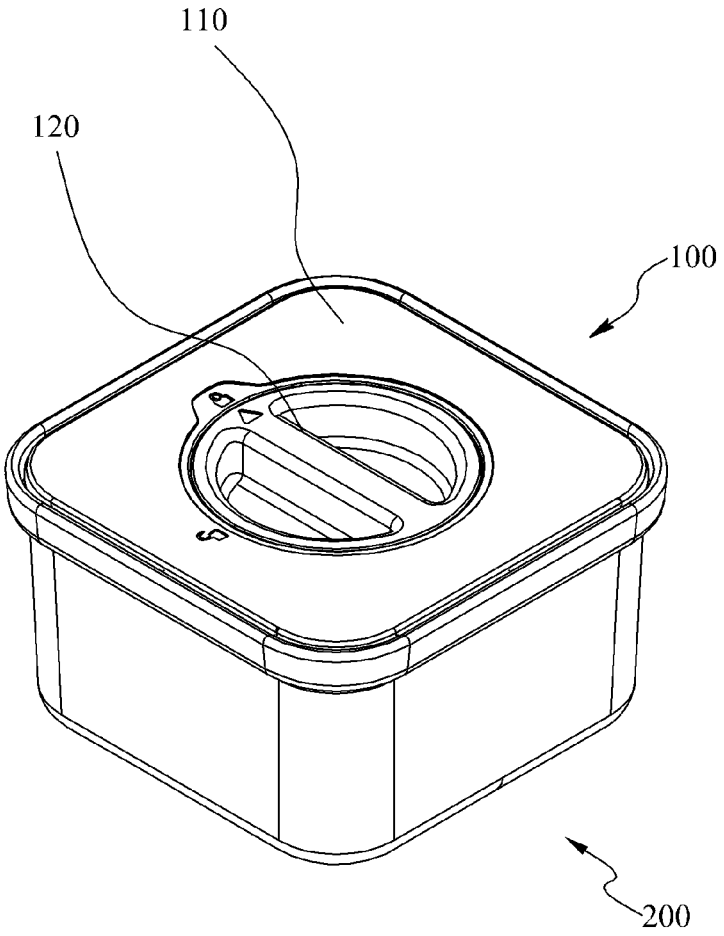
FIG. 1 is a perspective view of a closed container and a closed container cover, which are coupled, according to an embodiment of the present disclosure.
Figure 2:
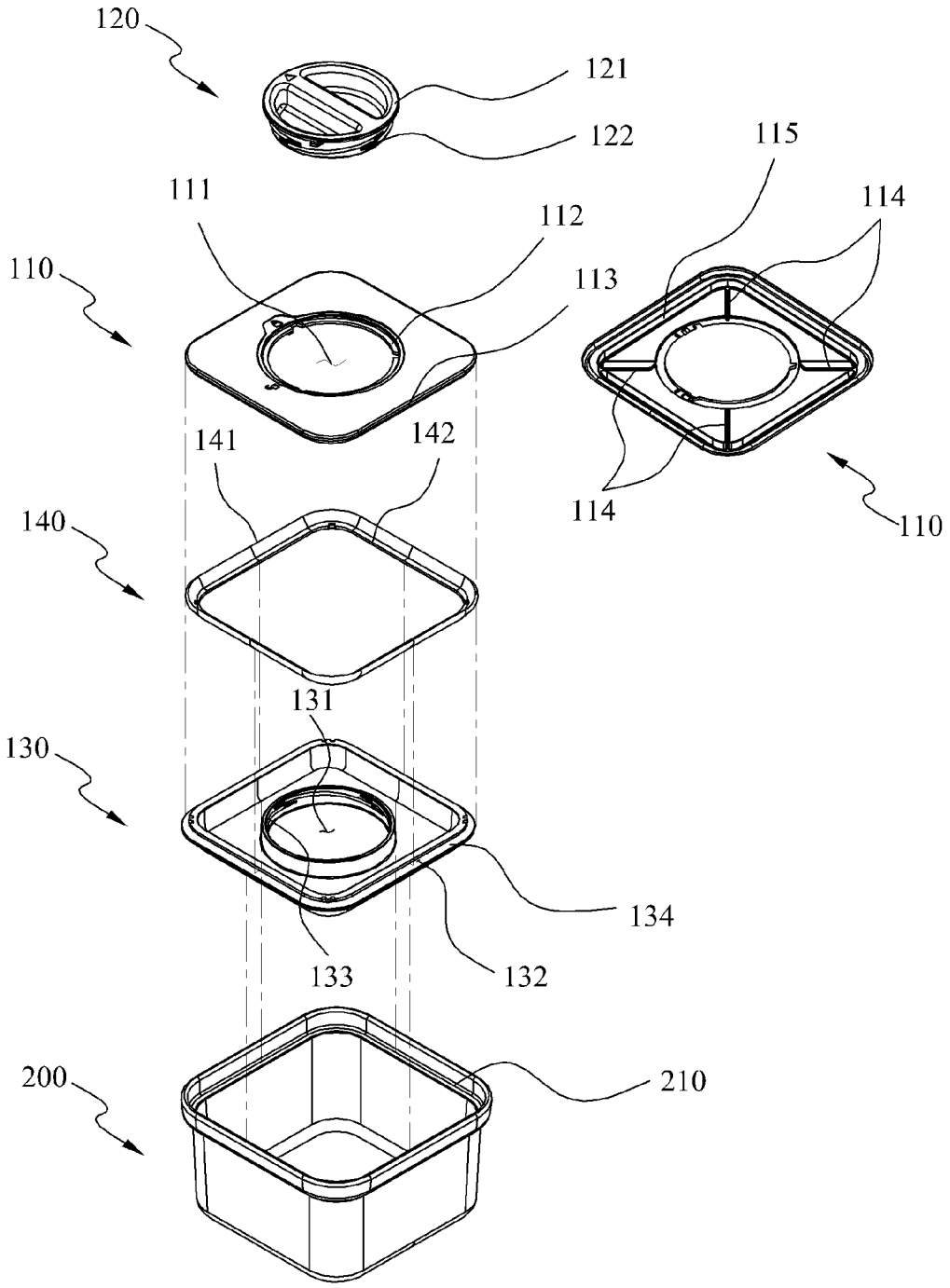
FIG. 2 is an exploded perspective view of a closed container and a closed container cover, which are separated, according to an embodiment of the present disclosure.

Referring to FIG. 1 or FIG. 2, a closed container cover 100 according to one embodiment of the present disclosure broadly includes an upper plate 110, a rotary knob 120, a lower plate 130 and a packing portion 140.

Figure 3:
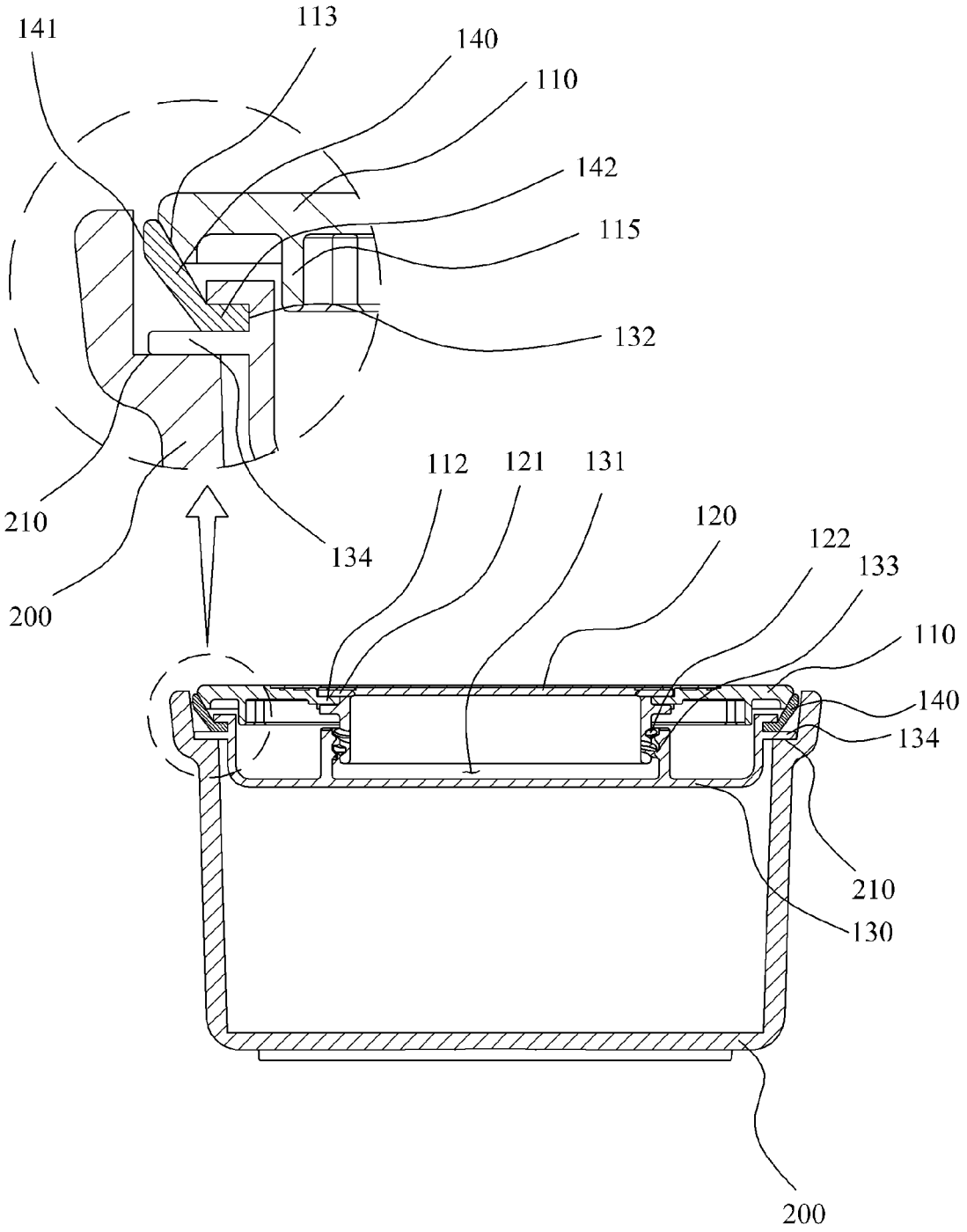
FIG. 3 is a cross-sectional view of a closed container and a closed container cover according to an embodiment of the present disclosure.
Figure 4:
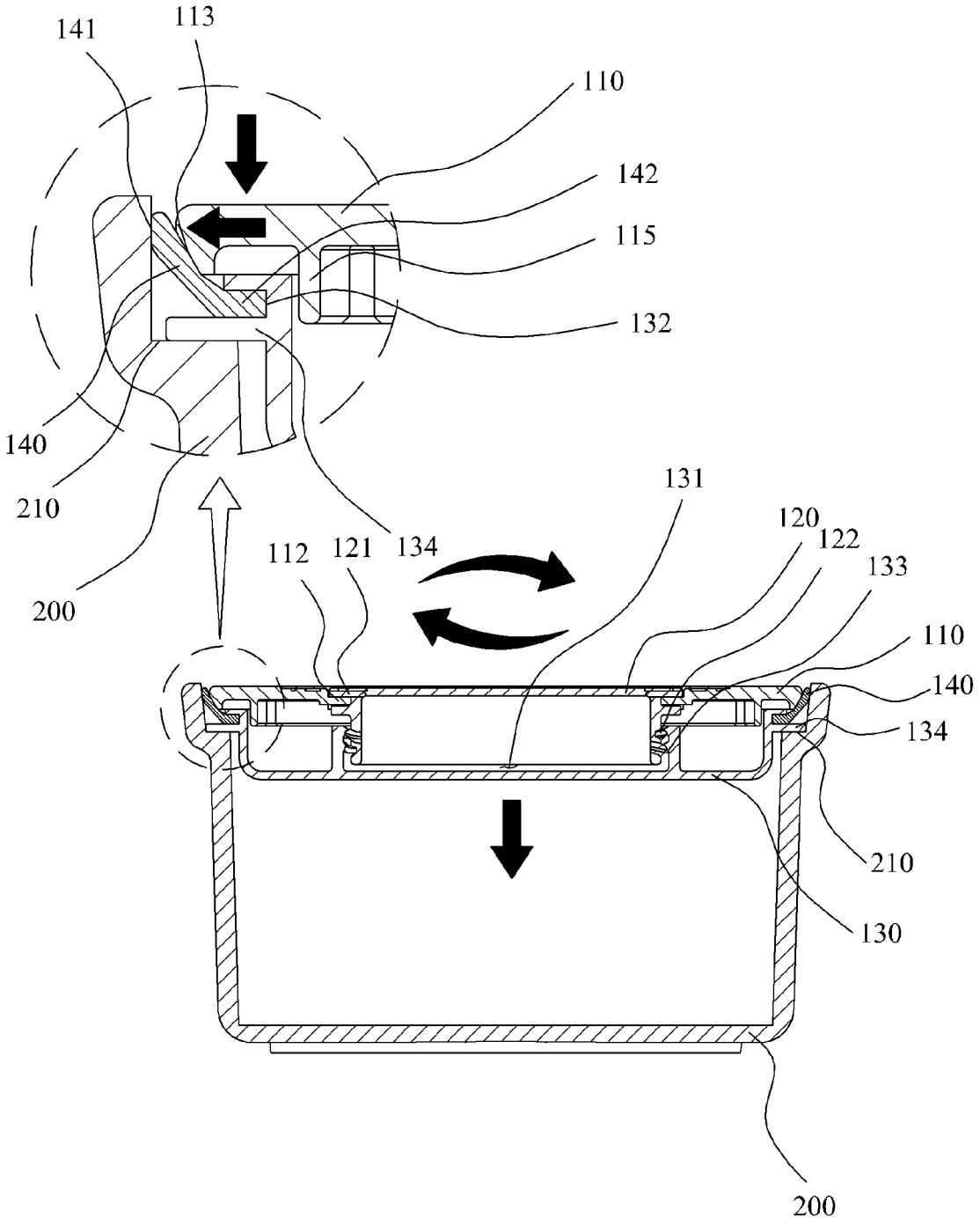
FIG. 4 is a cross-sectional view of a closed container cover, in which an upper plate is moved down by rotation of the rotary knob, according to an embodiment of the present disclosure.

First, the upper plate 110 will be described. As shown in FIG. 2, 3 or FIG. 4, the upper plate 110 is shaped like a quadrangle and moves up and down in accordance with rotation of the rotary knob 120 to be described later, thereby pushing the packing portion 140 (to be described later) provided on an outer surface of the lower plate 130 (to be described later) in an outward direction or returning the packing portion 140 to an original state. The upper plate 110 includes a coupling hole 111, a stepped portion 112, an inclined surface 113, a reinforcing rib 114 and an outer rib 115.

The coupling hole 111 is formed by perforating a center portion of the upper plate 110, and allows the rotary knob 120 to be rotated in a state that the rotary knob 120 is inserted therein and coupled to the upper plate 110.

The stepped portion 112 protrudes inward from an inner circumference of the coupling hole 111, and holds a wing 121 (to be described later) of the rotary knob 120 inserted in the coupling hole 111, thereby preventing the rotary knob 120 from being separated from the coupling hole 111.

The inclined surface 113 is formed on an outer circumference of the upper plate 110 and inclined at a predetermined angle. The inclined surface 113 is formed at the same angle as the inner surface of the packing portion 140 (to be described later), thereby guiding the upper plate 110 to press the packing portion 140 and elastically transform the packing portion 140 when the upper plate 110 is moved down by the rotation of the rotary knob 120.

Figure 5:
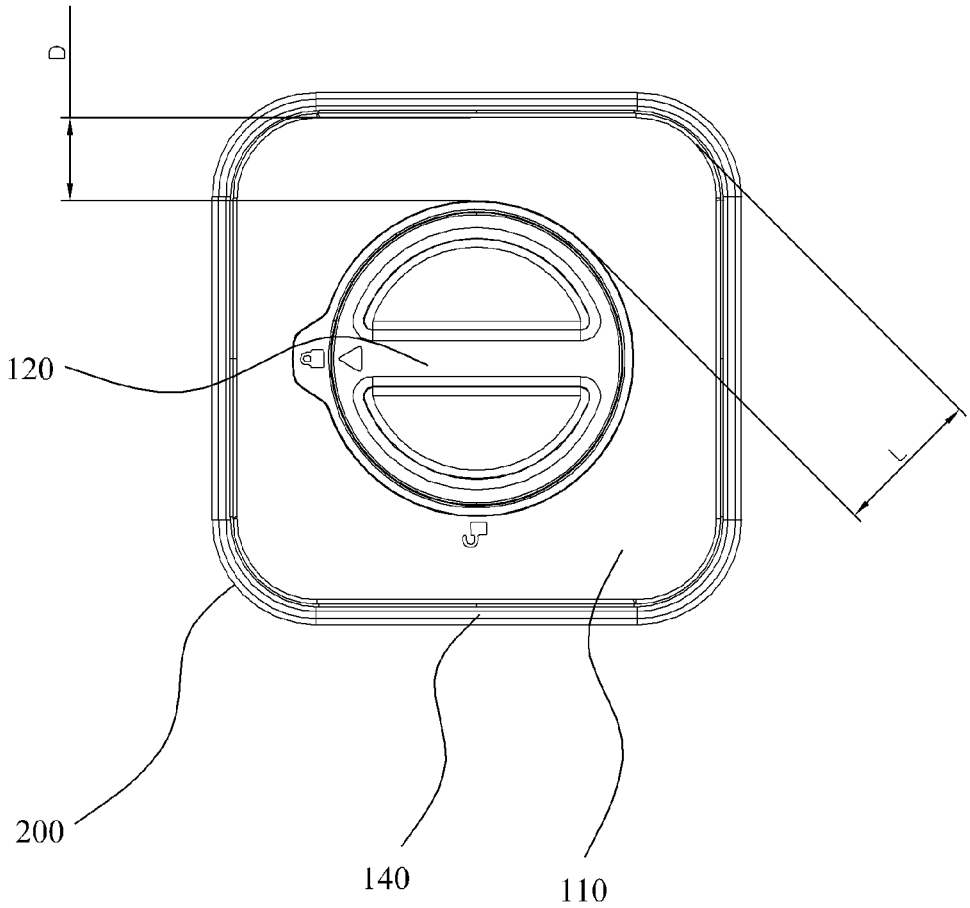
FIG. 5 is a plan view of a closed container and a closed container cover according to an embodiment of the present disclosure.

The reinforcing rib 114 is shaped like a horizontal bar formed at each of four bottom corners of the upper plate 110 as shown in FIG. 2 or FIG. 5, and prevents a diagonal portion of the upper plate 110 from being distorted or moved so that the maximum pressure can be transferred to the corners of the packing portion 140, i.e. in a diagonal distance L between the upper plate 110 and the coupling hole 111 longer than a horizontal distance D between the upper plate 110 and the coupling hole 111, when the upper plate 110 is moved down by the rotation of the rotary knob 120.

Thus, if the upper plate 110 is completely moved down, the whole outer circumference of the packing portion 140 is in close contact with the inner circumference of a container main body 200, thereby maximizing airtightness.

The outer rib 115 is shaped like a vertical band formed on a bottom circumference of the upper plate 110, and prevents the upper plate 110 from moving leftward and rightward or in the same direction as the rotary knob 120 while the upper plate 110 is moved down by the rotation of the rotary knob 120, thereby moving the upper plate 110 thoroughly in a vertical direction so that pressure can be uniformly applied to the whole inner circumference of the packing portion 140.

Next, the rotary knob 120 will be described. As shown in FIG. 2 or FIG. 3, the rotary knob 120 is inserted in the coupling hole 111 and rotates to move the upper plate 110 up or down. The rotary knob 120 is formed with the wing 121 on the top outer circumference thereof, so that the rotary knob 120 can be not only rotatably seated on the coupling hole 110 but also prevented from being separated outward from the coupling hole 110 in the state that the rotary knob 120 is inserted in the coupling hole 111.

Further, the rotary knob 120 is formed with a screw thread 122 on the bottom outer circumference thereof, and thus screw-coupled with a tap coupling groove 131 of the lower plate 130 (to be described later) so that the upper plate 110 can be moved up or down in accordance with the rotation of the rotary knob 120.

Next, the lower plate 130 will be described. As shown in FIG. 2 or FIG. 3, the lower plate 130 is coupled to the bottom of the upper plate 110, and seated on an inner receiving projection 210 of the container main body 200. The lower plate 130 includes the tap coupling groove 131, and an insertion groove 132.

The tap coupling groove 131 is formed in a center portion of the lower plate 130. Further, the tap coupling groove 131 is internally formed with a screw tap 132 to be screw-coupled with the screw thread 122.

The insertion groove 132 is recessed on the outer surface of the lower plate 130 so that a horizontal surface 142 of the packing portion 140 can be inserted in and coupled to the insertion groove 132.

In addition, the lower plate 130 may be additionally formed with a reinforcing rib receiving groove (not shown) corresponding to each of the reinforcing ribs 114 and inserting each of the reinforcing ribs 114 therein, thereby improving coupling between the upper plate 110 and the lower plate 130, further preventing the upper plate 110 from being distorted or moved by the rotation of the rotary knob 120, and guiding the upper plate 110 to move vertically.

Further, the lower plate 130 may be formed with a supporter 134 on the outer circumference thereof so as to be supported on the inner receiving projection 210.

Next, the packing portion 140 will be described. As shown in FIG. 2, 3 or 4, the packing portion 140 is made of an elastic material, and coupled to the outer circumference of the lower plate 130. Thus, the packing portion 140 is elastically transformed by pressure of the upper plate 110 so as to be in contact with or separated from the inner surface of the container main body 200. To this end, the packing portion 140 includes the horizontal surface 142 to be inserted in the insertion groove 132, and the outer circumference of the packing portion 140 is extended from the horizontal surface 142 and tapers outward.

Furthermore, a contact surface 141 is formed on the outer circumference of the packing portion 140 and has the same angle as the inner surface of the container main body 200, thereby closely contacting the inner surface of the container main body 200 and improving airtightness when the packing portion 140 is expanded outward as the upper plate 110 moves down.

As described above, according to an embodiment of the present disclosure, the upper plate moves down in accordance with the rotation of the rotary knob and pushes outward the packing portion provided on the circumference of the lower plate, thereby having advantages that the inside of the container main body is easily closed by a simple operation, and production processes are decreased with the minimum elements to increase efficiencies of the production and the processes and significantly reduce production costs and lowering a selling price.

A few exemplary embodiments have been shown and described in the drawings and the specification. Here, specific terms are used for only illustrative purposes, but not construed as limiting the meaning or the scope of the present disclosure defined in the appended claims. Accordingly, it will be appreciated by a person having an ordinary skill in the art that various changes and equivalents may be made in these exemplary embodiments without departing from the principles and spirit of the invention, the scope of which is defined in the appended claims.

| <Reference Numerals> | |
|---|---|
| 100: closed container cover | |
| 110: upper plate | 111: coupling hole |
| 112: stepped portion | 113: inclined surface |
| 114: reinforcing rib | 115: outer rib |
| 120: rotary knob | 121: wing |
| 122: screw thread | |

-continued

| <Reference Numerals> | |
|---|---|
| 130: lower plate | 131: tap coupling groove |
| 132: insertion groove | 133: screw tap |
| 134: supporter | |
| 140: packing portion | 141: contact surface |
| 142: horizontal surface | |
| 200: container main body | |
| 210: inner receiving projection | |
| D: horizontal distance between upper plate 110 and coupling hole 111 | |
| L: diagonal distance between upper plate 110 and coupling hole 111 | |

What is claimed is:

1. A closed container cover (100), which is coupled to an upper portion of a quadrangular container main body (200) and closes an inside of the container main body (200), the closed container cover (100) comprising:

an upper plate (110) configured to comprise a coupling hole (111) formed in a center portion thereof, and a stepped portion (112) formed on an inner surface of the coupling hole (111);

a rotary knob (120) configured to be inserted in the coupling hole (111), and comprising a wing (121) formed on an upper outer surface thereof and seated on the stepped portion (112), and a screw thread (122) formed an a lower outer surface;

a lower plate (130) configured to couple with the upper plate (110), and comprising a top coupling groove (131) formed in a center portion thereof and screw-coupling with the rotary knob (120), and an insertion groove (132) formed on an outer surface thereof; and a packing portion (140) configured to be made of an elastic material and inserted in the insertion groove (132), and comprising a circumferential surface tapering outward, wherein the upper plate (110) moves down so that an outer surface of the upper plate (110) can press an inner surface of the packing portion (140) and an outer surface of the packing portion (140) can be in contract with an inner surface of the container main body (100) if the rotary knob (120) is rotated in a state that the lower plate (130) is seated on an inner receiving projection (210) of the container main body (200);

the packing portion (140) comprises a contact surface (141) formed on an outer circumference thereof and having the same angle as the inner surface of the container main body (200) so as to be in close contact with the inner surface of the container main body (200) when the packing portion (140) is expanded outward as the upper plate (110) moves down; and the upper plate (110) comprises an inclined surface (113) formed on an outer circumference thereof at the same angle as the inner surface of the packing portion (140).

2. The combination of the cover and the container according to claim 1, wherein the upper plate (110) comprises a reinforcing rib (114) formed at a bottom corner thereof and arranged in a diagonal direction to transfer pressure to corners of the packing portion while the upper plate (110) is moved down by rotation of the rotary knob (120).

3. The combination of the cover and the container according to claim 2, wherein the upper plate (110) comprises an outer rib (115) formed on a bottom circumference thereof and preventing the upper plate (110) from rotating in the same direction as the rotary knob (120) while the upper plate (110) is moved down by the rotation of the rotary knob (120).

* * * * *